US005119618A

United States Patent [19]

Streck

[11] Patent Number: 5,119,618

[45] Date of Patent: Jun. 9, 1992

[54] SADDLE-FAULT CORRECTING SADDLE PAD

[75] Inventor: Donald A. Streck, Ojai, Calif.

[73] Assignee: Showa Hastumei Kaisha, Ltd., Kailua, Hi.

[21] Appl. No.: 474,479

[22] Filed: Feb. 2, 1990

[51] Int. Cl.[5] ..... B68C 1/12

[52] U.S. Cl. ..... 54/66

[58] Field of Search ..... 54/44, 65, 66

[56] References Cited

U.S. PATENT DOCUMENTS

| | | | |
|---|---|---|---|
| 357,981 | 2/1887 | Covell | 54/66 |
| 530,864 | 12/1894 | Torrey | 54/66 |
| 809,276 | 1/1906 | Aulton | 54/65 |
| 823,590 | 6/1906 | Eichhorn | 54/66 |
| 3,971,194 | 7/1976 | Morgan | 54/66 |
| 4,683,709 | 8/1987 | Vasko et al. | 54/66 |
| 4,695,496 | 9/1987 | Lee | 54/66 X |

FOREIGN PATENT DOCUMENTS

| | | | |
|---|---|---|---|
| 24920 | 11/1936 | Australia | 54/66 |
| 1514 | 4/1906 | United Kingdom | 54/66 |

*Primary Examiner*—Robert P. Swiatek
*Attorney, Agent, or Firm*—Donald A. Streck

[57] ABSTRACT

This is a corrective saddle pad for use under a saddle to provide a better fit of the saddle on a horse's back. The pad is in two portions connected by adjustable straps so as to sit on opposite sides of the horse's backbone. It further comprises a pair of washable inner pads and a pair of corrective outer pad releasable attached to one another. The washable inner pads have a layer of neoprene foam rubber in contact with the horse's skin to prevent rubbing and chafing. Each corrective outer pad is a multi-layer pad including a resiliently flexible pressure plate disposed along a support area of the horse's back along side the backbone and at least one packet filled with a fluid gel of a silicone material to transfer localized forces from the saddle across the pressure plate which has deformed to the shape of the horse's back thereunder whereby the packets lie against the pressure plate members with the fluid confined therein between the saddle and the pressure plate members so that localized forces from the saddle are hydraulically transferred over the surface of the pressure plates and over a broad area of the back of the horse. Provision is made to support the cantel portion of an English saddle when placed high on the horse's withers to prevent breakage of the saddle tree when jumping. This saddle pad has particular use and importance in endurance riding situations.

5 Claims, 4 Drawing Sheets

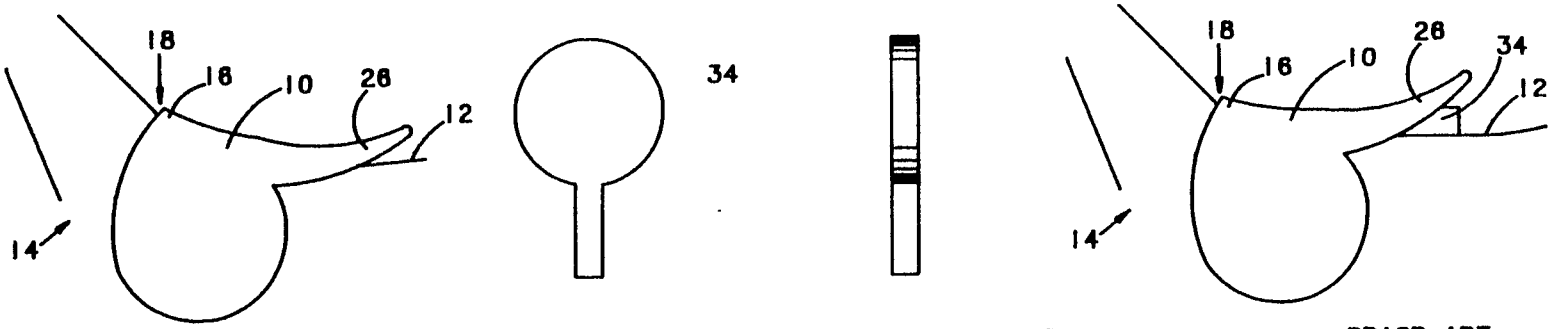
FIG. 11
PRIOR ART
FIG. 12
PRIOR ART
FIG. 13
PRIOR ART
FIG. 14
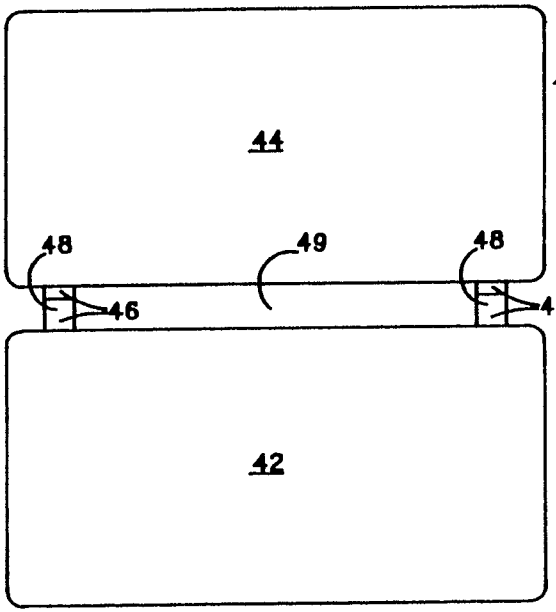
FIG. 15
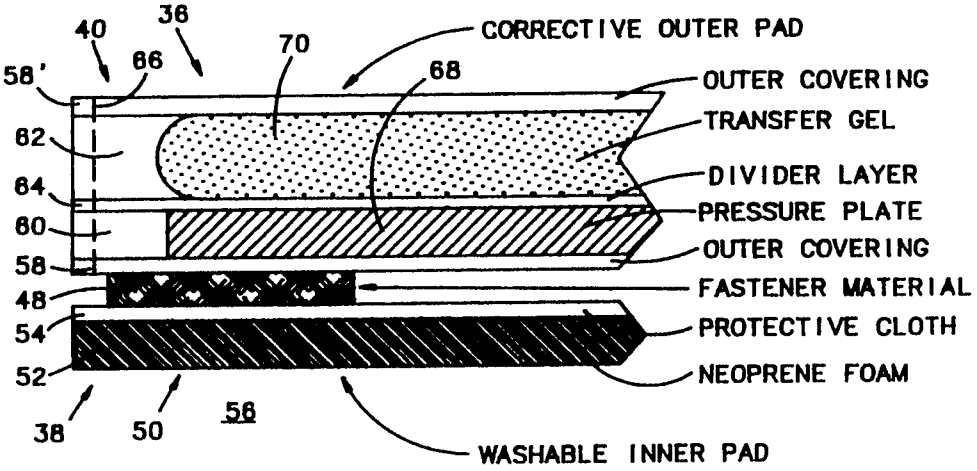
FIG. 16

SADDLE-FAULT CORRECTING SADDLE PAD

BACKGROUND OF THE INVENTION

This invention relates to equipment for riding on the back of a horse and, more particularly, to a corrective saddle pad for use under a saddle to provide a better fit of the saddle on a horse's back comprising, a layer of a first flexible sheeting material; a layer of a second flexible sheeting material disposed over the layer of first flexible sheeting material and fastened to the layer of first flexible sheeting material about peripheral edges to form a first compartment therebetween; and, force transfer means disposed within the first compartment for transferring localized forces from the saddle over a broad area of the back of the horse.

Saddles and associated equipment used for riding horses have not progressed much to date from that employed by people centuries ago for the same purpose. While the materials have improved somewhat, the basic design principles remain virtually unchanged. As depicted in FIGS. 1–5, the saddle 10 is placed on the back 12 of the horse 14 with the front or pommel 16 of the saddle 10 placed at about the withers 18 of the horse 14. As shown in FIGS. 2 and 3 (in greatly simplified form which is not necessarily to scale), there is a ridge 20 along the backbone of the horse 14 which must be cleared by any type of saddle. In some areas, as in the withers area of FIG. 2, the ridge 20 is relatively high and comprises muscle tissue while in other areas such as the middle of the back 12, as depicted in FIG. 3, the ridge is a thin layer over the backbone itself.

Most saddles fall into one of two broad categories—English (as depicted in FIG. 4) and Western (as depicted in FIG. 5). The English saddle 10 tends to be smaller and lighter in weight and thereby allows a rider to sit more forward on the back 12 of the horse 14 while the Western saddle 10' is heavier and larger and, therefore, causes the rider to sit further back on the horse 14. Virtually all saddles are built about a tree 22. So-called pack saddles are nothing but the tree as they are employed to load goods onto the back of the horse for packing purposes. In other words, the materials "riding" on the horse 14 are lashed on so as not to fall off and are not concerned with comfort. Riding saddles such as the English and Western saddles 10, 10' of FIGS. 4 and 5 have the trees 22 thereof covered, contoured, and padded to provide a more comfortable ride for the rider and, also, to position the rider so that his/her center of gravity is well placed with respect to the center of gravity of the horse.

Saddles and saddle trees remain more or less fixed in size and shape based on standards established centuries ago. A typical Western saddle tree 22 is depicted in simplified form in FIGS. 6 and 7. While a few trees are being made from synthetic materials such as plastic and fiberglass, the majority of trees are still being made of wood. The wood tree 22 is covered in rawhide as has been the practice for centuries; or, is covered in fiberglass if more modern materials are being used. As a result, a Western tree 22 as depicted in FIG. 6 and 7 will weigh in the neighborhood of forty pounds. By the time leather covering and padding is added, the resultant saddle will weigh upwards of fifty to sixty pounds. The tree 22 itself is of one piece construction and comprises a pommel 16 in the front (with or without a horn 24) and a cantel 26 in the back connected by sidepieces 28. Basically, there is the Arabian tree and the Quarter horse tree. The only difference being the distance between the sidepieces 28 and the vertical rise of the pommel 16 (so as to fit around the withers 18 without contacting). As depicted in FIGS. 6 and 7, the saddle tree 22 is supposed to fit over the ridge 20 at both the pommel 16 and cantel 26 and the sidepieces are supposed to fit along the back 12 of the horse 14 on either side of the ridge 20 spreading the weight of the rider over a large area.

Saddles are typically sized by the distance from the pommel 16 to the cantel 26 with a fifteen inch saddle being considered small and an eighteen inch saddle being considered large. Thus, the size variations are quite small. Unfortunately, such is not the case for the horses themselves. Just as with people, horses come in all sizes and shapes. There are large horses and small horses; fat horses and thin horses; tall horses and short horses. A hundred years ago, the horse was still a working animal. Horses were cheap and saddles were expensive. When you owned a $50 saddle and could buy a horse for $5, you shopped around and found a horse that fit your saddle. Working cowboys had a remuda of horses from which to chose each day. If a horse became sore from a misfit saddle, the cowboy used another horse and let the sore one recover.

The problem is that what is "supposed" to happen seldom does. Thus, as depicted in FIGS. 6 and 7, the tree 22 does not end up distributing the weight of the rider over broad areas of the back 12 on both sides of the ridge 20; rather, the horse is contacted at a narrow area 31 (as in FIG. 7) at front and back areas 32 (as in FIG. 6) of the sidepieces 28 of the tree 22. In an effort to protect the horse from the effects of this shape mismatching, the underside of the saddle 10, 10' under the tree is typically padded to some degree and usually covered with a fleece material. These conform to the shape of the tree 22 and, therefore, provide minimal beneficial effect—mostly visual false reliance by the rider. Partially in a further effort to offset the saddle tree mis-match problem, most riders employ a so-called "saddle pad" 30 such as that depicted in FIGS. 8 and 9. Sometimes, a rider will use a saddle pad 30 (or in the alternative a saddle blanket) simply to prevent sweat from the horse 14 from contacting the underside of the saddle 10, 10'. At the opposite end of the spectrum, some cowboys when roping may put several thick saddle pads 30 under their saddle to prevent the front ends of the tree 22 from digging into their horse's back when a rope is connected between the saddle horn 24 and a steer under extreme tension. The vast majority of riders choose a saddle pad which has sufficient thickness to (apparently) protect their horse's back from any mismatching of the saddle conformation. Materials and shape vary from pad to pad. A typical standard Western pad 30 is as shown in FIG. 9 comprising a rectangle of padding material 32 (such as a half-inch to inch thick felt material) with suede leather patches 33 sewn on at points of wear. As depicted in FIG. 10 (with only the tree 22 shown for clarity), the result is typically one of false security as the leather skirts and other covering portions of the saddle 10' conform to the pad 30 thus giving the visual belief to the rider that the saddle 10' is well padded over the back 12 of the horse 14 while, in fact, except for some minor prophylactic effect from the thickness of the material 32, the pressure from the saddle 10' is still concentrated on the horse's back as described above in what has been accurately described as a "four-legged stool" sitting on the horse's back.

There are other aspects of the saddle pad dilemma which are also worthy of at least brief consideration. A major driving force is the current price of saddles and horses. Horses can cost in the thousands and even tens of thousands of dollars. A cheap saddle is several hundreds of dollars and an average good saddle is a thousand dollars or more. In other words, neither is so cheap as to be discardable in the event of a minor size mismatch (obviously one does not try to use a pony saddle on a horse). Thus, given that the owner/rider is going to make the present combination of horse and saddle "work", the only thing left is the saddle pad. At the cost of saddle pads (typically $20–75), the saddle pad becomes the experimental or "throw-away" component. Thus, a rider may try pads of different thickness and materials, alone or in combination, in order to attempt to get a good "fit". The result may, in some cases, have more bad results than good. For example, remembering the difference between the Arabian and Quarterhorse tree as described above, it should be readily obvious that if the saddle/tree is too small for the horse to begin with, adding additional padding is only going to compound the problem and the saddle will end up sitting too high on the horse (in the manner of FIG. 10). Being of a somewhat compressible material, it can also lead to breakage of the tree—particularly with English saddles and in much the same manner as a problem to be described with respect to English saddles shortly. If a saddle fits on the horse in the manner of the tree 22 of FIG. 10, it can be appreciated that any downward force on the tree 22 (as from the weight of the rider) will result in a outward prying force on the sidepieces 28—which could break the tree 22.

As depicted in the drawing figures, the tree 22 of a typical Western saddle (all forty pounds of it) is substantial in size and thickness. Accordingly, it would be unusual for the Western tree 22 to break in normal usage. Such is not the case with the tree 22 of an English saddle. For one thing, the tree 22 in the area of the pommel 16 is much thinner. Thus, the English tree may split lengthwise from the prying effect of a thickness mis-match as described above; or, simply from fatigue from constant flexing due to the same prying effect. A more serious and common problem is depicted in FIGS. 11–14. Under certain riding conditions where it is desired to place the center of gravity of the rider as far forward as possible, it is common to mount the saddle 10 high up on the withers 18 as depicted in FIG. 11. In that position, however, the saddle 10 no longer has a level seat with a rising cantel 26; rather, the saddle 10 tends to slope "downhill" in a backwards direction. To compensate for this, the rider may employ a sponge rubber shim 34 as depicted in FIGS. 12 and 13. Placing the shim 34 under the saddle 10 produces the esthetic results of FIG. 14. It also results in an undue number of broken saddle trees for the following reason. The portion of the tree 22 under the pommel 16 is supported by the back 12 of the horse 14 while the portion of the tree 22 under the cantel 26 is virtually unsupported due to the compressibility of the sponge rubber of the shim 34. At the walk, the rider has no apparent problems; however, when going over a jump, the downward forces on the cantel portion of the tree 22 (from the rider's derriere or through the stirrup leathers when posting) compress the sponge rubber of the shim 34 and snap the tree 22 like breaking a pencil between the fingers.

It should be noted in passing that the foregoing problems are particular important in endurance riding where any soreing of the horse during the long ride can result in the elimination of the rider from that particular competition. Despite problems of equipment, the replacement of a rider's saddle is not always (or even often) a viable alternative.

Wherefore, it is an object of the present invention to provide a saddle pad for use with saddles of any kind which will spread the forces of the saddle tree over a maximum area.

It is another object of the present invention to provide a saddle pad for use with saddles of any kind which will help if fitting the saddle to the shape of the horse.

It is still another object of the present invention to provide a saddle pad for use with endurance saddles which will eliminate soreing problems and bypass the requirement to buy a new saddle.

It is yet another object of the present invention to provide a saddle pad for use with endurance saddles which can be modified to properly fit an old saddle to a new horse.

It is a further object of the present invention to provide a saddle pad for use with English saddles which will properly support the saddle in a proper riding position when the saddle is mounted high on the withers of the horse.

Other objects and benefits of this invention will become apparent from the detailed description which follows hereinafter when taken in conjunction with the drawing figures which accompany it.

SUMMARY

The foregoing objects have been achieved by the corrective saddle pad of the present invention for use under a saddle to provide a better fit of the saddle on a horse's back comprising, a layer of a first flexible sheeting material; a layer of a second flexible sheeting material disposed over the layer of first flexible sheeting material and fastened to the layer of first flexible sheeting material about peripheral edges to form a compartment therebetween; a layer of a third flexible sheeting material disposed between the layer of a first flexible sheeting material and the layer of a second flexible sheeting material whereby the compartment is divided into a first compartment and a second compartment; a washable inner pad of a neoprene foam material disposed releasably attached to a side of the corrective saddle pad facing the back of the horse whereby the neoprene foam material is in contact with the back of the horse; a pair of flat, resiliently flexible pressure plate members disposed within the first compartment to lie along the back of the horse on opposite sides of a backbone of the horse; and, a pair of packets each containing a fluid disposed within the second compartment over respective ones of the pressure plate members whereby the packets lie against the pressure plate members with the fluid confined therein between the saddle and the pressure plate members and hydraulically transfer localized forces from the saddle over a broad area of the pressure plate members and the pressure plate members deform to lie against the back of the horse and transfer forces from the saddle over a broad area of the back of the horse.

In the preferred embodiment, the second compartment has an opening thereto through which the packets can be inserted into the second compartment and be removed therefrom and a flap for selectively closing the opening whereby to prevent loss of the packets from the second compartment.

Also in the preferred embodiment, the layer of a first flexible sheeting material, the layer of a second flexible sheeting material, and the layer of a third flexible sheeting material are each in two portions with each portion containing at least one the packet and one the pressure plate member and there are connecting straps connected between the two portions at front ends and back ends thereof to provide an area along the backbone of the horse which is uncovered by the saddle pad. The preferred connecting straps each comprise two overlapping portions including means for releasably joining the portions together in varying overlapped relationships whereby the lengths of the connecting straps can be adjusted to size the saddle pad for different sized horses.

To solve the problem in English saddles of breakage when inadequately supported at the cantel, there is a supplemental packet containing the fluid and a booster pocket carried by the layer of a second flexible sheeting material at a position under a cantel portion of the saddle, the supplemental packet being disposed within the booster pocket whereby the supplemental packet lies against the back of the horse with the fluid confined therein between the saddle and the back of the horse to hydraulically support the cantel portion of the saddle to prevent breakage of the saddle from sudden downward forces.

The preferred fluid is a fluid gel silicone putty material which has high viscosity and reacts to sudden forces thereon in the manner of a resilient solid.

DESCRIPTION OF THE DRAWINGS

FIG. 11 is a simplified side view of the back of a horse with an English saddle placed thereon for riding as in FIG. 4 and depicting what happens when the saddle in placed far forward on the withers of the horse.

FIG. 12 is a plan view of a sponge rubber saddle shim according to the prior art which is used to correct the position of the saddle of FIG. 11.

FIG. 13 is a side view of the saddle shim of FIG. 12.

FIG. 14 is a simplified side view of the back of a horse with an English saddle placed thereon for riding as in FIG. 11 but with the saddle shim of FIGS. 12 and 13 employed under the saddle and depicting the partial results thereof.

FIG. 15 is a simplified plan view of a saddle pad according to the present invention.

FIG. 16 is a greatly enlarged cutaway edge view through a portion of a saddle pad according to the present invention.

DESCRIPTION OF THE PREFERRED EMBODIMENT

The corrective saddle pad of the present invention and the components thereof are depicted in FIGS. 15–23 wherein the pad is generally indicated as 36. As will be appreciated from the following description by those skilled in the art, the pad 36 of this invention incorporates many novel features which could offer benefits in and of themselves. The preferred pad 36, however, combines them all in one composite pad. In its preferred embodiment as best seen in the partial cross-section of FIG. 16, the pad 36 is comprised of two multi-layer pads 38 and 40 and a left portion 42 and a right portion 44. Despite the multiple layers (to be described in detail shortly), it is anticipated and preferred that the pad 36 be about one inch in maximum thickness (except for certain localized corrective aspects which will become apparent later).

Figure 1:
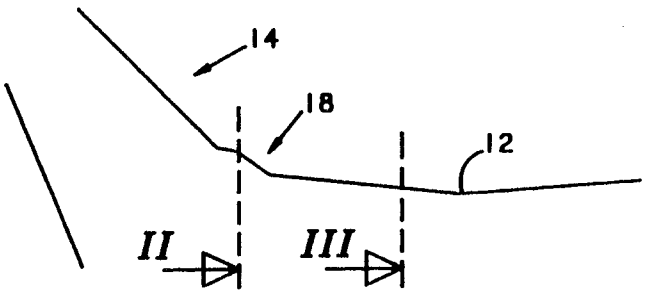
FIG. 1 is a simplified side view of the back of a horse in the area where a saddle is placed for riding.
Figure 2:
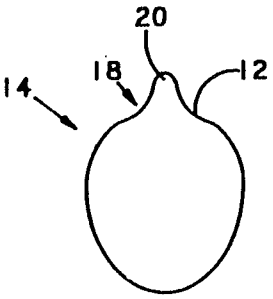
FIG. 2 is a simplified cutaway view of the horse of FIG. 1 in the plane II—II.
Figure 3:
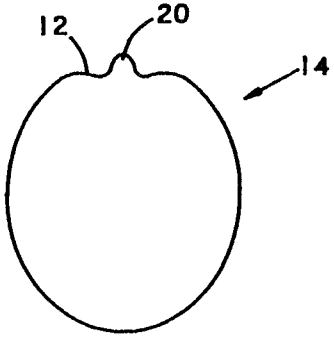
FIG. 3 is a simplified cutaway view of the horse of FIG. 1 in the plane III—III.
Figure 4:
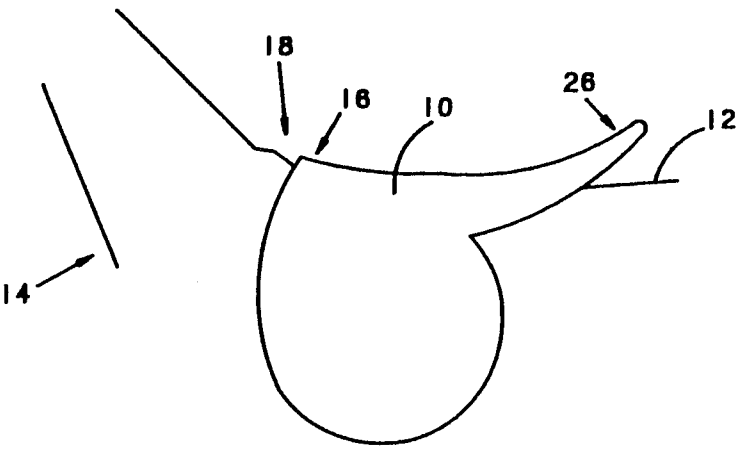
FIG. 4 is a simplified side view of the back of a horse as in FIG. 1 with an English saddle placed thereon for riding.
Figure 5:
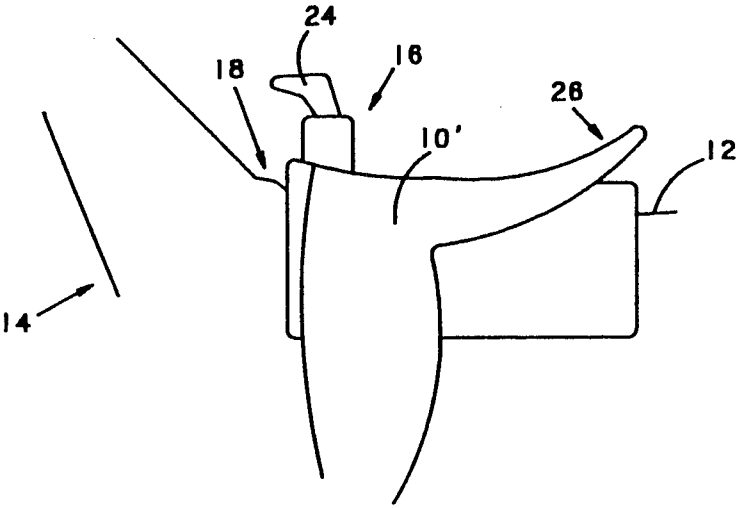
FIG. 5 is a simplified side view of the back of a horse as in FIG. 1 with a Western saddle placed thereon for riding.
Figure 8:
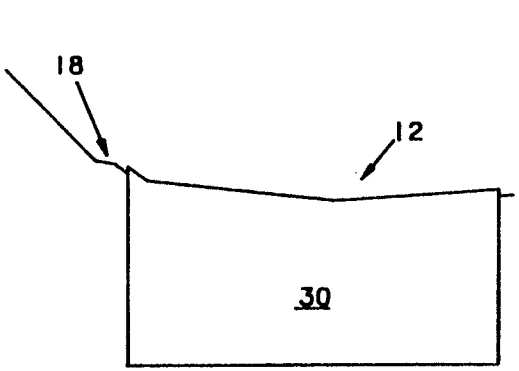
PRIOR ART FIG. 8
FIG. 8 is a simplified side view of the back of a horse as in FIG. 1 with a prior art saddle pad placed thereon prior to placing a saddle on the horse.
Figure 7:
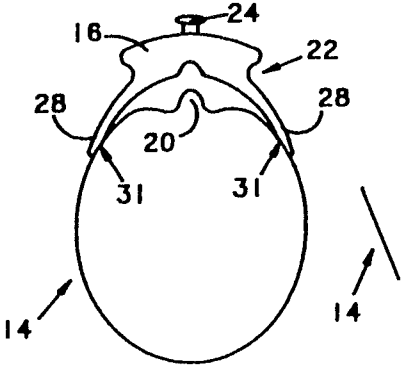
FIG. 7 is a simplified front view of the saddle tree of FIG. 6.
Figure 6:
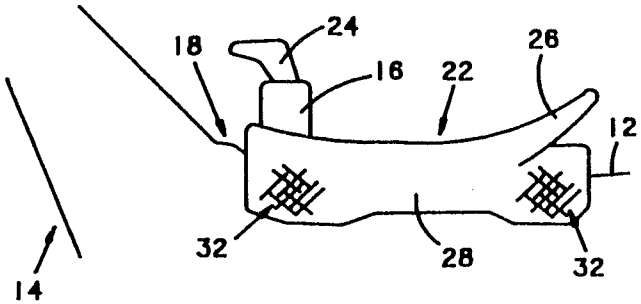
FIG. 6 is a simplified side view of the back of a horse as in FIG. 1 with the tree of a Western saddle placed thereon.
Figure 10:
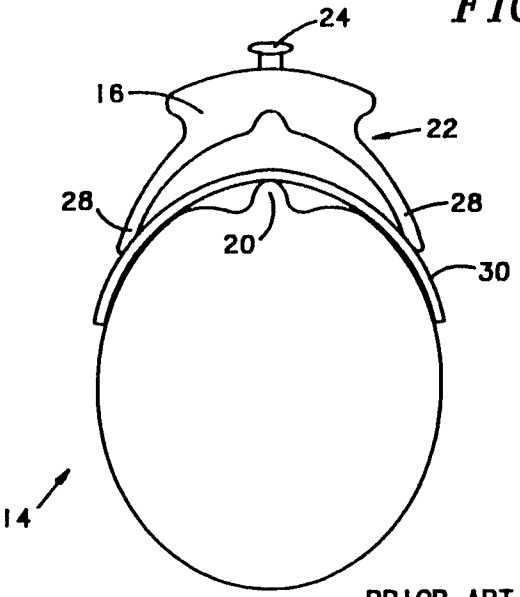
PRIOR ART FIG. 10
FIG. 10 is a simplified front view of the back of a horse as in FIG. 7 with the tree of a Western saddle placed on the prior art saddle pad of FIG. 8 and showing the way in which the saddle tree contacts the horse's back.
Figure 9:
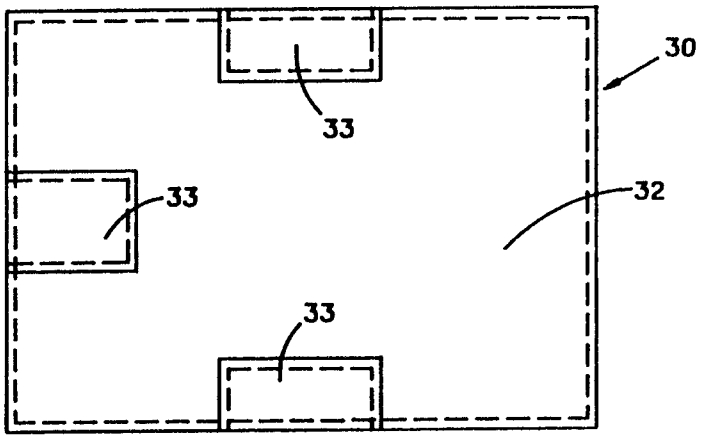
PRIOR ART FIG. 9
FIG. 9 is a simplified plan view of a prior art saddle pad.
Figures 17, 18, 19, 20, 21, 22, 23:
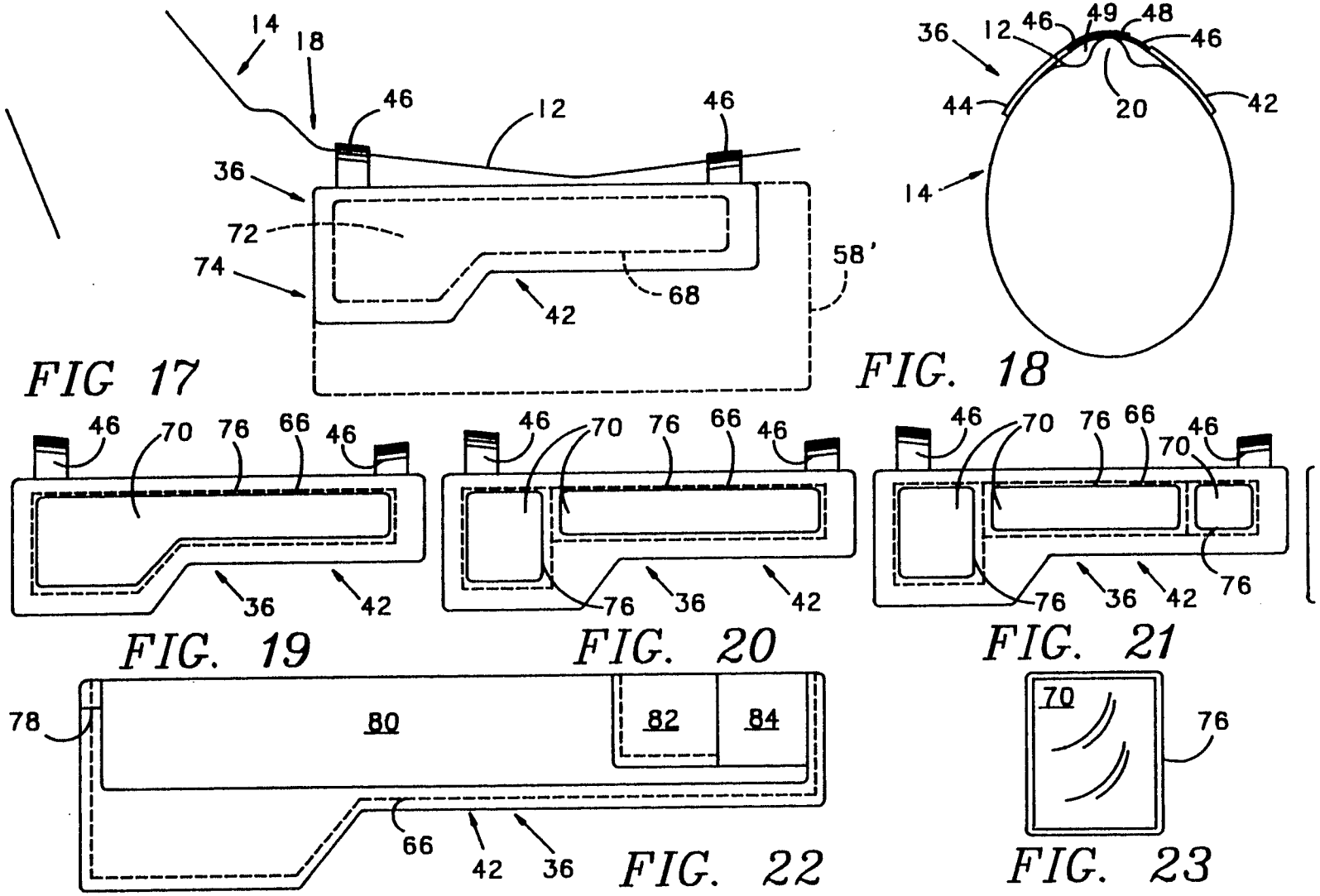
FIG. 17 is a simplified side view of the back of a horse as in FIG. 1 with a saddle pad according to the present invention placed thereon and showing the pressure plate of one side thereof ghosted.
FIG. 18 is a simplified front view of the back of a horse with the saddle pad of the present invention placed thereon and showing the way in which the saddle pad of the present invention is adjustably fit to the horse's back.
FIG. 19 is a simplified side view of one half of the saddle pad of the present invention and showing one embodiment for transfer fluid gel packets provided therein to transfer pressure from the saddle tree to the pressure plate.
FIG. 20 is a simplified side view of one half of the saddle pad of the present invention and showing another embodiment for transfer fluid gel packets provided therein to transfer pressure from the saddle tree to the pressure plate.
FIG. 21 is a simplified side view of one half of the saddle pad of the present invention and showing still another embodiment for transfer fluid gel packets provided therein to transfer pressure from the saddle tree to the pressure plate.
FIG. 22 is an enlarged simplified side view of one half of the saddle pad of the present invention and showing the preferred embodiment for transfer fluid gel packets provided therein to transfer pressure from the saddle tree to the pressure plate wherein the transfer fluid gel packets are removeably inserted into pockets provided therefor and including booster pockets at the rear for receiving supplemental fluid gel packets to support a saddle in the manner of the shim of FIGS. 12 and 13.
FIG. 23 is a simplified plan view of a transfer fluid gel packet as would be inserted into the pockets of the saddle pad of FIG. 22.

As shown in FIGS. 15 and 16, the two portions 42, 44 are interconnected at the front and back by overlapped tabs 46 having a touch fastener material 48 (such as that sold under the trademark Velcro) thereon whereby the amount of overlap of the tabs 46 (and thereby the spacing between the portions 42, 44) can be adjusted. As depicted in FIG. 18, the pad 36 is first placed over the back 12 of a new horse 14 and the tabs 46 adjusted so that the portions 42, 44 are properly positioned on either side of the ridge 20. It should be noted in this regard at this point that, unlike the thick prior art pad 30, the pad 36 of this invention does not tend to bunch up on the withers and interfere with saddle fit as described above. Moreover, the open channel 49 between the pad portions 42, 44 aids in cooling the horse 14 as, apparently, much of a horse's heat is released along the backbone area.

The washable inner pad 38 is releasably attached to the corrective outer pad 40 also preferably with touch fastener material 48. Snaps, or the like, could probably be used (if placed at edge locations); but, are not preferred because of their size and rigid nature.

The preferred washable inner pad 38 is made of a cloth covered neoprene material 50 of the type employed for so-called "wetsuits" used for scuba diving and surfboarding. There is a layer of neoprene foam 52 having a protective layer of cloth 54 bonded thereto. If desired (but not preferred), a thin layer of nylon, or the like, could be sewed around the edges of the material 50 and over the cloth 54. The inner pad 38 is placed on the horse 14 with the neoprene foam 52 in contact with the skin 56 of the horse 14. The foam 52 tends to absorb the sweat from the horse 14. It is soft and supple and moves with the skin 56 thereby preventing any abrading action against the horse's skin 56. Rubbing, if any, takes place between the cloth 54 and the corrective outer pad 40 above it. As can be appreciated, the inner pad 38 is a low cost portion of the pad 36 which can be replaced separately if it becomes overly soiled or worn. The therapeutic and prophylactic effect of the foam 52 against the skin 56 of the horse 14 should not be underestimated or overlooked in light of the benefits of the corrective outer pad 36 now to be described in detail.

The corrective outer pad 40 has outer coverings 58, 58' on both sides. A tough nylon or canvas material is preferred for the outer coverings 58, 58'; but, a material such as suede leather could be used if desired. The pad 40 between the outer coverings 58, 58' is divided into an inner compartment 60 and an outer compartment 62 by a divider layer 64. The divider layer 64 is also preferably of a tough nylon or canvas material with a suede leather being a second alternative. The pad 40 has the layers comprising the outer coverings 58, 58' and the divider layer 64 sewed together about the edges as by the stitching 66.

A pressure plate 68 is disposed within each of the two inner compartments 60 (one in each portion 42, 44). A transfer fluid gel 70 is disposed within each of the two outer compartments 62 (also one in each portion 42, 44). The construction and functioning of these two components will now be described in detail. As depicted in FIG. 17, the pad 36 as being described herein is preferably shaped to fit the area of interest (for saddle support) under the saddle on the horse's back. For use with Western saddles in particular, however, it may be desirable to have at least the outer covering 58' extend out further in the form of a saddle blanket in order to protect the skin 56 of the horse 14 from chafing by leather portions of the saddle 10' extending beyond the tree 22 thereof as indicated by the dashed lines 58' of FIG. 17.

As depicted by the dashed line labeled 68 in FIG. 17 the pressure plate 68 within the inner compartment 60 is preferably shaped to fit along the preferred pressure area on either side of the ridge 20 with an enlarged pressure pad 72 over the shoulder area of the horse at 74. The configuration of the pressure plate 68 of FIG. 17 is that which would be employed primarily with an English saddle. For a Western saddle (with its tree 22 with broad and elongated sidepieces 28), a second pressure pad 72 is preferred at the opposite end of the plate 68 to support the back ends of the tree 22. The plate 68 is intended to transmit forces applied thereto at points to a broad area under the plate 68. To accomplish this, it is preferred that the plate 68 be formed of a resiliently rigid material such as metal, fiberglass, plastic, or the like. To keep weight down, it should be lightweight. Thus, if metal is used, a light stainless steel or aluminum would be preferred. A slat of one of the modern carbon fiber materials, or such, would probably work well; but, would add considerably to the cost. The material has the additional requirement that it be of a thickness which will allow it to torsionally deform to the contours of the horse's back and shoulder areas. If it cannot do that, there would be no functional difference from that of the thick, rigid Western tree's sidepieces as described above. As those skilled in the art will readily recognize and appreciate, a slat of aluminum shim stock employed as the pressure plate 68 would readily twist to conform to the contours of the horse's body; but, would transmit forces over the entire plate 68, as desired.

With nothing more than the portions thereof described to this point, the pad 36 of this invention would provide a substantial improvement over prior art saddle pads. The aspect now to be described adds an additional large measure of correctiveness to the pad 36. As depicted in FIGS. 19–21, the outer compartment 62 is filled with a transfer fluid gel 70. The fluid gel 70 is a fluid and, therefore, it is preferred that the fluid gel 70 be contained in a leakproof container. As depicted in FIG. 23, the fluid gel 70 could be provided in packets 76 of a thick polypropylene plastic, or the like. As depicted in FIGS. 19–21, one or more packets 76 could be sewed (as by the stitching 66) into the outer compartment 62. The choice of one or more packets 76 is a function of the amount of fluid transfer for compensation purpose that is desired. Where the horse will be constantly at a walk (as in trail riding) the conformation of the horse's back will probably remain fairly constant and, therefore, more localized packets 76 of a thinner construction will probably be preferred. By contrast, where the horse may be walking, loping, or galloping, a single packet with a larger amount of fluid gel 70 therein could prove to be more adaptive to changes in back conformation such as the flattening of the back that takes place during extension).

A preferred construction for the portions 42, 44 is shown in FIG. 22. In this embodiment, there is access to the outer compartments 62 through an opening along the top edge at 78 which is covered (and closed) with a thin flap 80 having touch fastener material (not shown) along its bottom edge for holding the flap 80 in a closed position. As thus configured, packets 76 of the fluid gel 70 can be inserted into the outer compartments 62 as necessary for different horses and different riding conditions. In such an embodiment, it may be desirable to place the packets 76 in a cloth covering also having touch fastener material thereon to interact with mating touch fastener material within the outer compartments 62 and other packets 76 to prevent shifting thereof.

To solve the problem described above with respect to FIGS. 11-14, a booster pocket 82 is provided at the top rear of each portion 42, 44 for receiving a supplemental fluid gel packet 76 to support the rear of an English saddle 10 in the manner of the shim 34 of FIGS. 12 and 13 when the saddle 10 is positioned high on the withers in the manner of FIG. 11. The booster pockets 82 are sewn to the outer covering 58' or to the flap 80, as appropriate. A flap 84 (with touch fastener closing) is provided on each booster pocket 82.

Having thus described the various embodiments and their physical construction in detail, the preferred transfer fluid gel 70 and its unique characteristics will now be described in detail. While virtually any fluid could be employed as the fluid gel 70 within the packets 76, the preferred fluid gel is a silicone material of the type sold for children for entertainment purposes under the tradename Silly Putty. This material has unique attributes which make it particularly suited for the task at hand. For one, it is extremely light as compared with water or other common fluids. For another, it is somewhat viscous; that is, it is a putty consistency and only flows over a long period of time. If one were to roll it into a ball and place it on a flat surface, it would ultimately (but not immediately) form a pool on the surface. A chief attribute can be seen by dropping the same ball onto the surface—it will bounce; that is, in response to a sudden force the material acts like a resilient solid. Consider, therefore, the result of using this material as the fluid gel 70 within the packets 76. It will flow to conform to the contours of the horse's back and to the irregularities in the surface of the saddle and its tree. As the horse moves normally, the material will bend and move to maintain a constant pressure surface between the saddle/tree and the pressure plates 68 (which as described above also bend and twist to maintain full contact with the horse). Since it is, in fact, a fluid, it acts like any confined fluid; that is, forces on it are transmitted through it equally and undiminished in all directions. Thus, pressures from the saddle/tree on the outer surfaces of the packets 76 are transmitted by the fluid gel 70 across the entire surfaces of the pressure plates 68. Consider an instantaneous force such as those on packets 76 within the booster pockets 82 during a jump, however. As will be remembered, in such circumstances the preferred silicone material of the fluid gel 70 acts as a resilient solid, which is exactly what is required. The momentary downward force on the cantel portion of the tree of the descending rider is not met with a compressible shim as in the prior art approach; but rather, with what at the time is a resilient solid which fully supports the weight of the rider on the horse's back and prevents the saddle tree from being broken in the manner described earlier herein.

Wherefore, having thus described my invention, what is claimed is:

1. A corrective saddle pad for use under a saddle to provide a better fit of the saddle on a horse's back comprising:

a) a layer of a first flexible sheeting material;

b) a layer of a second flexible sheeting material disposed over said layer of first flexible sheeting material and fastened to said layer of first flexible sheeting material about peripheral edges to form a first compartment therebetween, said first compartment comprising a longitudinal first portion disposed along one side of the horse's spine and parallel thereto and a longitudinal second portion disposed along an opposite side of the horse's spine and parallel thereto;

c) force transfer means disposed within said longitudinal first portion and said longitudinal second portion of said first compartment for transferring localized forces from the saddle over broad longitudinal areas of the back of the horse on opposite sides of the horse's spine and parallel thereto, said force transfer means comprising a pair of flat, resiliently rigid, substantially non-shock absorbing pressure plate members disposed within respective ones of said longitudinal first portion and said longitudinal second portion of said first compartment to lie along the back of the horse on opposite sides of the horse's spine and of a thickness whereby said pressure plate members deform to lie against the back of the horse and transfer localized forces from the saddle over broader areas of the back of the horse.

2. A corrective saddle pad for use under a saddle to provide a better fit of the saddle on a horse's back comprising:

a) a layer of a first flexible sheeting material;

b) a layer of a second flexible sheeting material disposed over said layer of first flexible sheeting material and fastened to said layer of first flexible sheeting material about peripheral edges to form a first compartment therebetween, said first compartment comprising a longitudinal first portion disposed along one side of the horse's spine and parallel thereto and a longitudinal second portion disposed along an opposite side of the horse's spine and parallel thereto;

c) force transfer means disposed within said longitudinal first portion and said longitudinal second portion of said first compartment for transferring localized forces from the saddle over broad longitudinal areas of the back of the horse on opposite sides of the horse's spine and parallel thereto, said force transfer means comprising a fluid gel disposed within respective ones of said longitudinal first portion and said longitudinal second portion of said first compartment to lie along the back of the horse on opposite sides of the horse's spine whereby to hydraulically transfer localized forces from the saddle over broader areas of the back of the horse.

3. The corrective saddle pad of claim 2 wherein:

said fluid gel is a silicone material which has high viscosity and reacts to sudden forces thereon in the manner of a resilient solid.

4. A corrective saddle pad for use under a saddle to provide a better fit of the saddle on a horse's back comprising:

a) a layer of a first flexible sheeting material;

b) a layer of a second flexible sheeting material disposed over said layer of first flexible sheeting material and fastened to said layer of first flexible sheeting material about peripheral edges to form a compartment therebetween, said compartment comprising a longitudinal first portion disposed along one side of the horse's spine and parallel thereto and a longitudinal second portion disposed along an opposite side of the horse's spine and parallel thereto;

c) force transfer means disposed within said longitudinal first portion and said longitudinal second portion of said compartment for transferring localized forces from the saddle over broad longitudinal areas of the back of the horse on opposite sides of the horse's spine and parallel thereto, said force transfer means comprising, c1) a pair of flat, resiliently rigid pressure plate members disposed within respective ones of said longitudinal first portion and said longitudinal second portion of said first compartment to lie along the back of the horse on opposite sides of the horse's spine and of a thickness whereby said pressure plate members deform to lie against the back of the horse and transfer localized forces from the saddle over broader areas of the back of the horse, and c2) a silicone material having high viscosity and deformation resistive qualities disposed within respective ones of said longitudinal first portion and said longitudinal second portion of said first compartment to lie along the back of the horse on opposite sides of the horse's spine whereby to deform to adapt to static shape changes of the back of the horse while transferring dynamic localized forces from the saddle over broader areas.

5. The corrective saddle pad of claim 4 and additionally comprising:

a) a supplemental packet of a silicone material which has high viscosity and resiliently reacts to sudden forces thereon; and, b) a booster pocket carried by said layer of a second flexible sheeting material at a position under a cantel portion of the saddle, said supplemental packet being disposed within said booster pocket whereby said supplemental packet lies against the back of the horse with said silicone material between the saddle and the back of the horse to support the cantel portion of the saddle against sudden downward forces.

* * * * *